United States Patent [19]

Siefert et al.

[11] 4,282,596

[45] Aug. 4, 1981

[54] ALARM CLOCK CASE SHUT-OFF DEVICE

[75] Inventors: Roland Siefert, Bad Durrheim; Roland Sauter, Schwenningen, both of Fed. Rep. of Germany

[73] Assignee: Kienzle Uhrenfabriken GmbH, Schwenningen, Fed. Rep. of Germany

[21] Appl. No.: 117,995

[22] Filed: Feb. 4, 1980

[30] Foreign Application Priority Data

Feb. 6, 1979 [DE] Fed. Rep. of Germany ... 7903198[U]

[51] Int. Cl.[3] ..... G04B 23/00

[52] U.S. Cl. ..... 368/262

[58] Field of Search ..... 368/72, 244, 250, 262, 368/264

[56] References Cited

U.S. PATENT DOCUMENTS

| | | | |
|---|---|---|---|
| 1,381,225 | 6/1921 | Pfeifer, Jr. | 368/262 |
| 2,996,875 | 8/1961 | Graef | 368/262 |
| 3,352,101 | 11/1967 | Michael et al. | 368/262 |
| 3,797,223 | 3/1974 | Oliveri | 368/262 |

FOREIGN PATENT DOCUMENTS

| | | | |
|---|---|---|---|
| 1356163 | 5/1963 | France | 368/262 |
| 933903 | 8/1963 | United Kingdom | 368/262 |

*Primary Examiner*—Vit W. Miska

*Attorney, Agent, or Firm*—Pascal & Associates

[57] ABSTRACT

A switching off device for an alarm clock having a case with a two-part casing in which the front edge, preferably a locking hook of one casing part, can be connected with a locking means, preferably a depression on the top of the clock. A switching off mechanism is associated with the locking means and is operated when pressure is exerted on the top of one casing part. The locking means is arranged on a slide which projects beyond the upper contour of the clock in one position thereof in which the alarm is operating.

3 Claims, 6 Drawing Figures

ALARM CLOCK CASE SHUT-OFF DEVICE

The invention relates to a switching off device for an alarm clock with a casing having a two-part casing in which the front edge, preferably the locking hook of one casing part is connectable with a locking means, preferably a depression on the top of the clock, a switching off mechanism being associated with said locking means and which is operated when pressure is applied to the top of one casing part.

For alarm clocks with cases, it is already known to provide a depression on the top of the clock in which engages the locking hook of one casing part, a lever being arranged in the depression and is used for operating the switching off mechanism. If the alarm mechanism is operating, switching off can take place if a pressure is exerted on the top of one casing part.

It is disadvantageous in this case that it is not possible to establish whether the alarm mechanism is in the operating state or whether it is switched off. To reliably establish that the alarm mechanism is in the operating state or in order to bring it into the operating state, the winding up member for the alarm mechanism must be turned which brings the latter into the operating state.

The problem is to so construct the switching off device that it is possible to clearly establish whether the alarm mechanism is in the operating state and also so that the alarm mechanism can easily be brought into one of its two operating states.

This problem is solved by the features of claim 1. Advantageous developments can be gathered from the subclaims.

Figure 1:
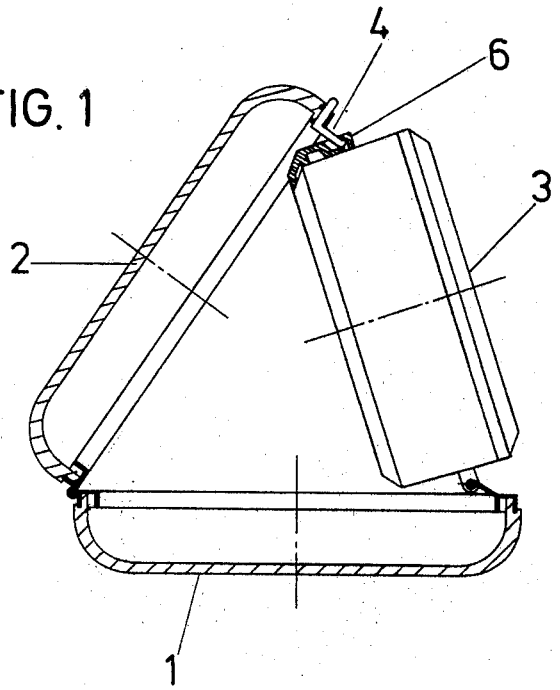

An embodiment of the invention is explained hereinafter relative to the drawings, wherein show:

FIG. 1 a vertical section through the casing parts and a side view of the clock with the alarm mechanism operational.

Figure 2:
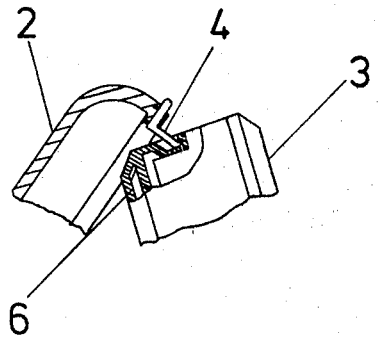

FIG. 2 a corresponding part section with the alarm mechanism switched off.

Figure 3:
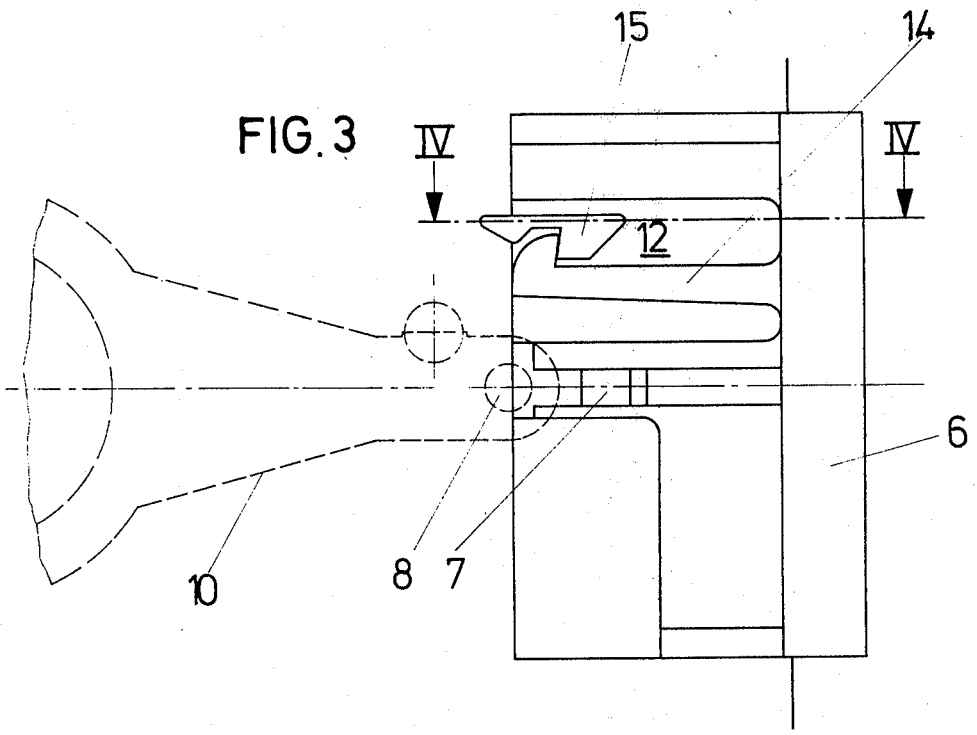
Figure 4:
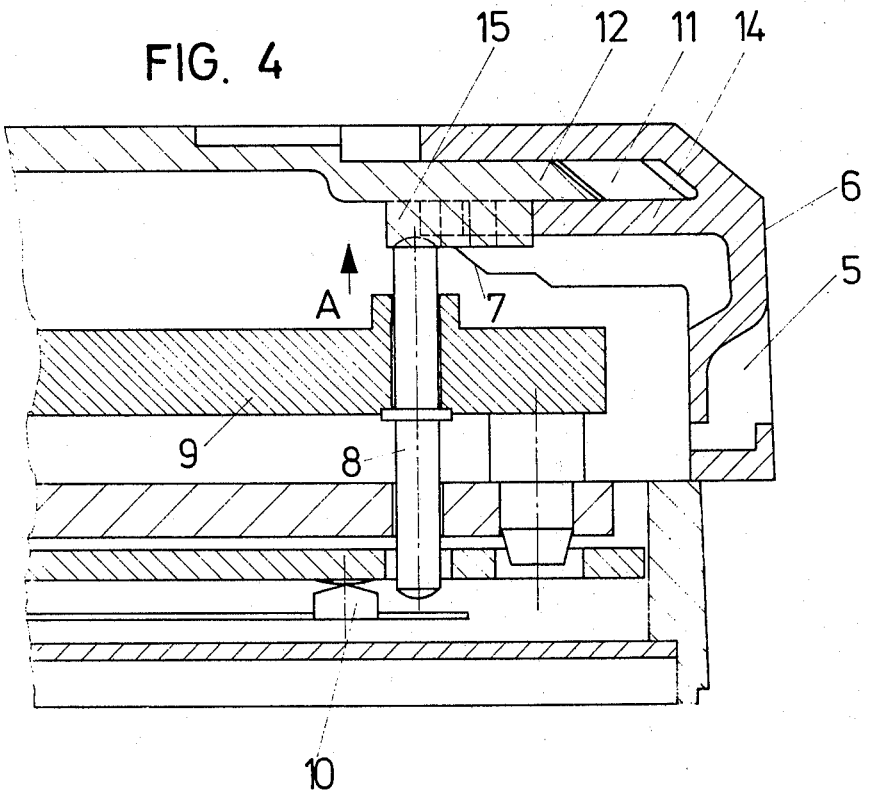

FIG. 3 a view in the direction of arrow A of FIG. 4 with the alarm mechanism operational.

FIG. 4 a section along the line IV—IV of FIG. 3.

Figure 5:
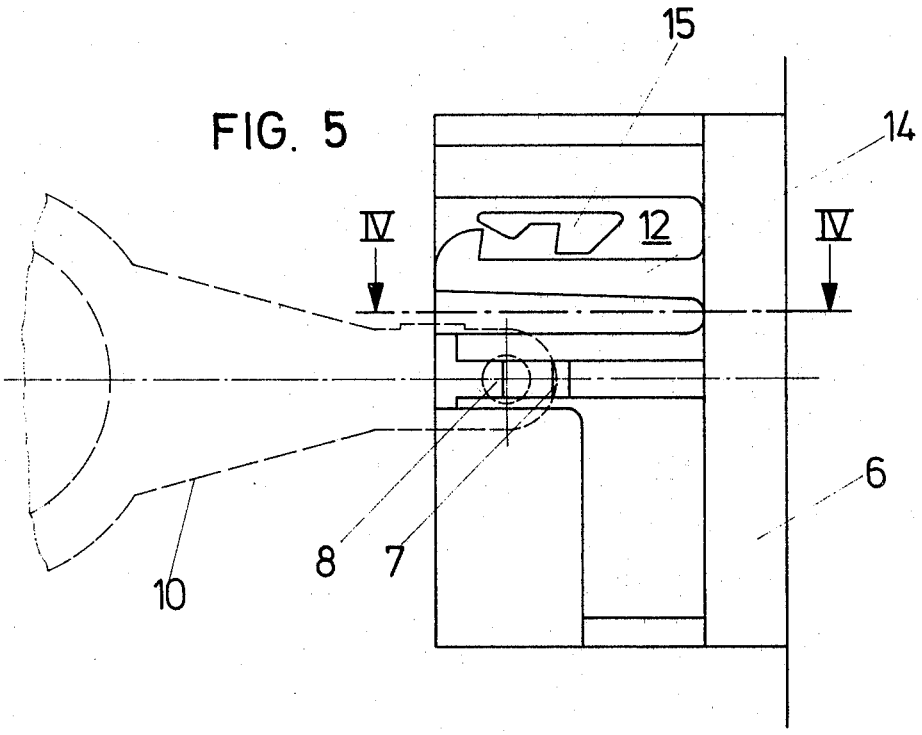

FIG. 5 a view corresponding to FIG. 3 with the alarm mechanism switched off.

Figure 6:
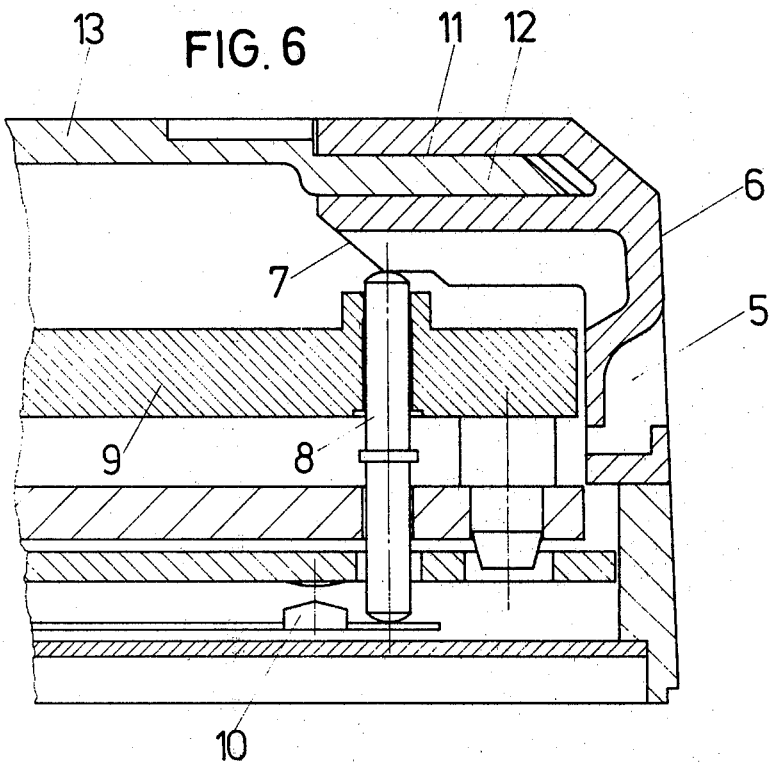

FIG. 6 a section along the line VI—VI of FIG. 5.

According to FIG. 1, the two casing parts 1, 2 together with the clock 3 when the latter is set up form a triangle, the locking hook 4 of casing part 2 engaging in a depression 5 of clock 3. This depression 5 is located on the top of a slide 6. If the alarm mechanism is to be brought into the operating state, slide 6 is slid upwards and then projects above the upper contour of clock 3.

However, if the alarm mechanism is to be brought into the non-operating state, the slide 6 is slid downwards and is then flush with the top of clock 3, as shown in FIG. 2. If the alarm clock is set up as in FIG. 1, it is merely necessary to exert a pressure on the top of the casing part 2 and as a result slide 6 is slid in via locking hook 4.

On the inside, slide 6 has an inclined ramp 7. If slide 6 is in a position where the alarm mechanism is operational, the ramp 7 does not act on the pin 8 which is mounted in a plate 9. In this position, the alarm release spring 10 makes contact, so that the alarm mechanism is operational.

In the position of FIG. 6, the alarm mechanism is switched off. In the inserted state of slide 6 ramp 7 has displaced pin 8 in such a way that the alarm release spring 10 has broken the circuit to the alarm mechanism sound generator.

Slide 6 has a guide recess 11 in which engages a portion 12 of the casing rear wall 13. Part of the inner wall of guide recess 11 is constructed as an elastic hook 14 which cooperates with a locking member 15 on wall portion 12. As can best be gathered from FIG. 3., hook 14 and locking member 15 determine the position of slide 6 in its slid up position.

Alarm clock 3 can also be used without the casing parts 1, 2 and in this case a base is fitted to the bottom of clock 3. To switch off the alarm mechanism a pressure is exerted by the hand directly onto slide 6.

We claim:

1. A switching off apparatus for an alarm clock including a casing having a rear wall, comprising a slide which projects beyond the upper contour of the clock in one position in which the alarm is operated, a switching off mechanism associated with the slide and operated when pressure is exerted on the slide, a guide recess in the slide for engaging a portion of said rear wall, a part of the inner wall of the guide recess forming a resilient hook, a locking member on said portion of the rear wall, the hook and locking member cooperating to define said one and a second position of said slide.

2. A switching off apparatus for an alarm clock as defined in claim 1, including an alarm release spring, the inward side of the slide formed as an inclined ramp for operating the alarm release spring when the slide is moved under the influence of said pressure.

3. A switching off apparatus for an alarm clock as defined in claim 2, further including a pin disposed between said ramp and said alarm release spring, the clock mechanism having at least one plate, said plate being arranged as a guide for said pin.

* * * * *